US008863465B2

(12) United States Patent
Bott

(10) Patent No.: US 8,863,465 B2
(45) Date of Patent: Oct. 21, 2014

(54) STACKABLE WALL BLOCK SYSTEM

(75) Inventor: Timothy A. Bott, Sunfish Lake, MN (US)

(73) Assignee: Allan Block, LLC, Edina, MN (US)

( * ) Notice: Subject to any disclaimer, the term of this patent is extended or adjusted under 35 U.S.C. 154(b) by 0 days.

(21) Appl. No.: 13/241,714

(22) Filed: Sep. 23, 2011

(65) Prior Publication Data

US 2013/0074437 A1 Mar. 28, 2013

(51) Int. Cl.
*E04B 5/04* (2006.01)
*E02D 29/02* (2006.01)

(52) U.S. Cl.
CPC ..... *E02D 29/025* (2013.01)
USPC ..... 52/605; 52/604; 52/562; 52/568

(58) Field of Classification Search
CPC ..... E04B 2/42; E04B 2/44; E04B 2/46; E04B 2/48; E04B 2/8611; E04B 2/8617; E04B 2/8635; E04B 2/08; E04B 2/10; E04B 2/18; E04B 2/20; E04B 2/28; E04B 2/30; E04B 2/32; E04B 2/34; E04B 2/36; E02D 29/0233; E02D 29/0225; E02D 29/025; E02D 17/205
USPC ..... 52/561, 562, 564, 565, 568, 415, 418, 52/422, 424, 426, 427, 428, 431, 596, 597, 52/598, 604, 605, 607, 563, 582.1, 586.2, 52/585.1, 589.1, 590.1, 590.2; 405/262, 405/286, 284
See application file for complete search history.

(56) References Cited

U.S. PATENT DOCUMENTS

| | | | | | |
|---|---|---|---|---|---|
| 1,329,893 | A | * | 2/1920 | Flynn | 52/562 |
| 1,405,995 | A | * | 2/1922 | Flynn | 52/428 |
| 3,379,017 | A | | 4/1968 | Kusatake | |
| 3,464,211 | A | | 9/1969 | Andersen | |
| 4,597,236 | A | | 7/1986 | Braxton | |
| 4,815,897 | A | | 3/1989 | Risi et al. | |
| 4,889,310 | A | * | 12/1989 | Boeshart | 249/41 |

(Continued)

FOREIGN PATENT DOCUMENTS

| | | | |
|---|---|---|---|
| EP | 0112213 | A1 | 6/1984 |
| FR | 1012498 | A | 7/1952 |

(Continued)

OTHER PUBLICATIONS

Brochure, "The next generation segmental retaining wall system . . . GRAVITY STONE", Westblock Products, Inc., patent pending 1992, 3 pages.

*Primary Examiner* — Jessica Laux
(74) *Attorney, Agent, or Firm* — Fredrikson & Byron, P.A.

(57) ABSTRACT

A segmental wall block system including one or more a face units and one or more anchoring units. The face units each have a front face and a rear face and one or more channels formed in the rear face, the channels extending from the upper surface to the lower surface of the face unit along a face unit height. The anchoring units each have a first connector on a first end and a second connector on a second end. The first and second connectors are sized to slide into and be interlocked with the channels of the face unit. The distance between the upper surface and the lower surface of the anchoring unit forms its height, which is approximately uniform and is approximately one half of the height of the face unit. The anchoring units may also include one or more grooves on the connectors.

20 Claims, 7 Drawing Sheets

(56) References Cited

U.S. PATENT DOCUMENTS

| | | | | |
|---|---|---|---|---|
| 4,896,999 | A * | 1/1990 | Ruckstuhl | 405/286 |
| 4,909,010 | A | 3/1990 | Gravier | |
| 5,315,802 | A * | 5/1994 | Hart | 52/607 |
| 5,337,527 | A | 8/1994 | Wagenaar | |
| 5,350,256 | A | 9/1994 | Hammer | |
| 5,474,405 | A | 12/1995 | Anderson et al. | |
| 5,484,236 | A | 1/1996 | Gravier | |
| 5,623,797 | A | 4/1997 | Gravier et al. | |
| 5,688,078 | A | 11/1997 | Hammer | |
| 5,707,184 | A | 1/1998 | Anderson et al. | |
| 5,788,423 | A | 8/1998 | Perkins | |
| 5,820,304 | A | 10/1998 | Sorheim et al. | |
| 5,878,545 | A | 3/1999 | Gebhart | |
| 6,062,772 | A | 5/2000 | Perkins | |
| 6,082,067 | A | 7/2000 | Bott | |
| 6,082,933 | A | 7/2000 | Maguire et al. | |
| 6,189,282 | B1 * | 2/2001 | VanderWerf | 52/582.1 |
| D459,487 | S | 6/2002 | Bott | |
| 6,523,317 | B1 | 2/2003 | Bott et al. | |
| 6,745,537 | B1 * | 6/2004 | Hamilton | 52/574 |
| 6,854,236 | B2 | 2/2005 | Bott | |
| 6,948,282 | B2 | 9/2005 | Bott | |
| 7,198,435 | B2 | 4/2007 | Dolan et al. | |
| 7,207,146 | B1 | 4/2007 | Morrell | |
| 7,410,328 | B2 * | 8/2008 | Hamel | 405/286 |
| 7,775,747 | B2 * | 8/2010 | Bott | 405/286 |
| D667,141 | S * | 9/2012 | Bott | D25/113 |
| 2001/0029717 | A1 * | 10/2001 | Spakousky | 52/405.4 |
| 2004/0161307 | A1 * | 8/2004 | Hammer | 405/284 |
| 2005/0254906 | A1 | 11/2005 | Dolan et al. | |
| 2007/0196184 | A1 * | 8/2007 | Hammer et al. | 405/284 |
| 2007/0292216 | A1 * | 12/2007 | Hamel | 405/286 |
| 2010/0018146 | A1 * | 1/2010 | Aube et al. | 52/483.1 |
| 2012/0073229 | A1 * | 3/2012 | Castonguay et al. | 52/426 |

FOREIGN PATENT DOCUMENTS

| | | | |
|---|---|---|---|
| FR | 2536777 | A1 | 6/1984 |
| FR | 2542783 | A2 | 9/1984 |
| JP | 2000230240 | | 8/2000 |
| WO | 8808063 | | 10/1988 |

* cited by examiner

STACKABLE WALL BLOCK SYSTEM

TECHNICAL FIELD

The present disclosure pertains segmental wall block, and more particularly to stackable segmental wall blocks for retaining walls and parapets.

BACKGROUND

Retaining walls and parapets are two common types of walls which can be constructed using segmental wall blocks. Retaining walls are commonly employed to retain highly positioned soil, such as soil forming a hill, to provide a usable level surface therebelow such as for playgrounds and yards, or to provide artificial contouring of the landscape which is aesthetically pleasant. Parapets, on the other hand, are free standing walls having two exposed sides which, in some cases, may be located directly on top of retaining walls or other structures.

Retaining walls and parapets have been made of concrete blocks having various configurations, the blocks generally being stacked one atop another. Retaining wall blocks are generally stacked against an earthen embankment with the wall formed by the blocks extending vertically or being formed with a setback. Setback is generally considered to be the distance in which one course of a wall extends beyond the front of the next highest course of the same wall. Parapets blocks are generally stacked in a single stack, or in a pair of stacks separated by a small but variable distance, which may be filled and generally are stacked without a setback. Concrete blocks have been used to create a wide variety of mortared and mortarless walls. Such blocks are often produced with a generally flat rectangular surface for placement onto the ground or other bearing foundation and for placement onto lower blocks in erecting the wall. Such blocks are also often further characterized by a frontal flat or decoratable surface and a flat planar top for receiving and bearing the next course of blocks forming the wall.

It is generally desired that walls of the type described exhibit certain favorable characteristics, including the ease with which the wall can be assembled, the stability of the wall (that is, its ability to maintain structural integrity for long periods of time), and the ability of the wall to admit and disburse rainwater. Although segmental wall blocks commonly are supported vertically by resting upon each other, in the case of retaining walls, it is important that the blocks be restrained from moving outwardly from the earthen wall that they support. In the case of parapets, it is important that the wall be stable if the surface on which the parapet rests, such as the ground or a retaining wall, shifts, and that the parapet be able to withstand impacts or other forces pressing against it.

Current manufacturing techniques and the economics associated therewith limit the shapes, sizes, and materials that may be used to manufacture blocks that still provide the functions described above. In some instances, it would be preferred to make blocks in different shapes, sizes, and colors, and using different quality, types, and price of materials, and possibly in a centralized location which may be further from their point of use. Accordingly, the segmented retaining wall blocks must be transported to the installation location. When segmented wall blocks are transported to the installation location, they are typically stacked on a pallet for easier transportation. Blocks or block components that do not stack evenly can result in stacks that are not of uniform size. For instance, one row may lean heavily in a particular direction. This risks having the shipment not fit in or on its transporting vehicle. Of greater concern, though, are that blocks that do not stack evenly may be less stable than desired.

SUMMARY OF THE INVENTION

Embodiments of the invention include segmental wall block systems including one or more face units and one or more anchoring units. The face units each include a front face, a rear face opposite the front face, an upper surface, a lower surface opposite the upper surface, and one or more channels formed in the rear face. The channels extend from the upper surface to the lower surface along a face unit height. The anchoring units include a first end forming a first connector, a second end forming a second connector, a central portion extending from the first end to the second end, an upper surface, and a lower surface opposite the upper surface. The distance between the upper surface and the lower surface forms a height of the anchoring unit which is approximately uniform from the first end to the second end of the anchoring unit. At least one of the first and second connectors is sized to slide into and be interlocked with the channels of at least one of the face units. The height of the anchoring unit is approximately one half of the face unit height. In some embodiments, there are two channels and two anchoring units. The first and second connectors of one of the anchoring units may be sized to simultaneously slide into and be interlocked with the channels of two of the face units, whereby the segmental wall block system may be used to construct a parapet wall.

In some embodiments, the first connector has a shape which is a mirror image of a shape of the second connector. The first end may flare laterally outward of the central portion to form the first connector, and the second end may flare laterally outward of the central portion to form the second connector.

In some embodiments, each anchoring unit includes first and second opposing side surfaces with a first groove on the first side surface of the first connector and a second groove on either the first side surface of the second connector or on the second side surface of the first or the second connector. Each of the first and second grooves may extend from the upper surface to the lower surface of anchoring unit. The connectors and the grooves are positioned and shaped such that when a first and a second anchoring unit are placed in abutment, one or both connectors of the first anchoring unit can nest within one or both grooves of the second anchoring unit.

In some embodiments, each of the first and second connectors is sized to form a gap between an inner wall of the channel and the connector when the connector is placed within the channel. The gap may allow the anchoring unit to rotate laterally within the channel up to about 24 degrees in total.

The first connectors of two of the anchoring units may be sized to simultaneously slide into and be interlocked with the channels of two of the face units, whereby the two of the anchoring units may be stacked when interlocked to reach a combined height equal to the face unit height. Embodiments of the invention also include segmental wall block systems including one or more face units and one or more anchoring units having a first groove and a second groove. The face units include a front face, a rear face opposite the front face, an upper surface, a lower surface opposite the upper surface, and one or more channels formed in the rear face, the channels extending from the upper surface to the lower surface along a face unit height. The anchoring units include a central portion extending from a first end to a second end, a first side surface, and a second side surface opposite the first side surface. The first end flares laterally outward of the central portion to form a first connector and the second end flares laterally outward of the central portion to form a second connector. At least one of the first and second connectors is sized to slide into and be interlocked with the channels of the face unit. The first groove in the first side surface of the first connector extends from the upper surface to the lower surface of anchoring unit, and the second groove in either the first side surface of the second connector or in the second side surface of the first or the second connector extends from the upper surface to the lower surface of the anchoring unit. The first and second connectors and the first and second grooves are positioned and shaped such that when a first and a second anchoring unit are placed in abutment, one or both connectors of the first anchoring unit can nest within one or both grooves of the second anchoring unit, whereby the nesting provides an alignment mechanism for the one or more anchoring units when palletized for shipment.

In some embodiments, the first connector has a shape which is a mirror image of a shape of the second connector.

In some embodiments, the anchoring unit have an upper surface and a lower surface opposite the upper surface and the distance between the upper surface and the lower surface forms a height of the anchoring unit which is approximately uniform from the first end to the second end of the anchoring unit.

Embodiments of the invention further include a wall forming a combination retaining wall and parapet wall. The retaining wall portion is constructed of a first plurality of segmental retaining wall blocks positioned to form at least one course of the wall. The parapet wall portion of the wall is positioned on the retaining wall portion and constructed of a second plurality of segmental wall blocks, with the second plurality of segmental wall blocks positioned to form at least one course of the wall. Each segmental wall block of the retaining wall portion includes a face unit and one or more anchoring units. The face units include a front face, a rear face opposite the front face, an upper surface, a lower surface opposite the upper surface, and one or more channels formed in the rear face, the channels extending from the upper surface to the lower surface along a face unit height. The anchoring units include a central portion extending from a first end to a second end, each anchoring unit have a first side surface and a second side surface opposite the first side surface, the first end flaring laterally outward of the central portion to form a first connector, the second end flaring laterally outward of the central portion to form a second connector, and at least one of the first and second connectors interlocked with the channels of the face unit. The segmental wall block of the parapet wall portion includes two or more of the face units, the rear faces of the two or more face units oriented to face each other, and one or more of the anchoring units positioned such that at least one of the first and second connectors is interlocked with the channels of at least one of the two of the face units. The two or more face units of each segmental wall block of the parapet wall portion may be positioned in a staggered configuration. In some embodiments, the one or more of the anchoring units are positioned such that the first and second connectors are interlocked with the channels of both of the two of the face units. In some embodiments, the wall is curved.

In some embodiments, the first connector has a shape which is a mirror image of a shape of the second connector. In some embodiments, the height of each anchoring units is approximately one half of the face unit height. In some embodiments, the anchoring units interlocked with the channels of the face units are interlocked with a gap that allows the anchoring unit to rotate laterally within the channel by an amount of up to about 24 degrees in total.

BRIEF DESCRIPTION OF THE DRAWINGS

The following drawings are illustrative of particular embodiments of the invention and therefore do not limit the scope of the invention. The drawings are not necessarily to scale (unless so stated) and are intended for use in conjunction with the explanations in the following detailed description. Embodiments of the invention will hereinafter be described in conjunction with the appended drawings, wherein like numerals denote like elements.

DETAILED DESCRIPTION

Figure 1:
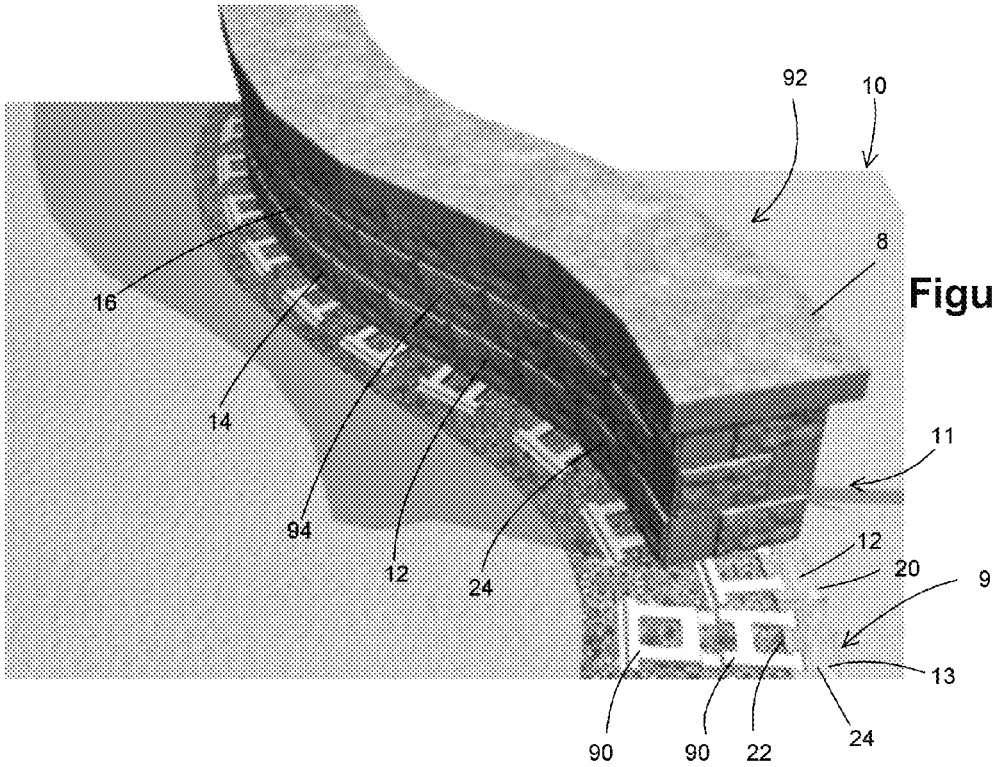
FIG. 1 is a back perspective view of a retaining wall and parapet according to embodiments of the invention.
Figure 2:
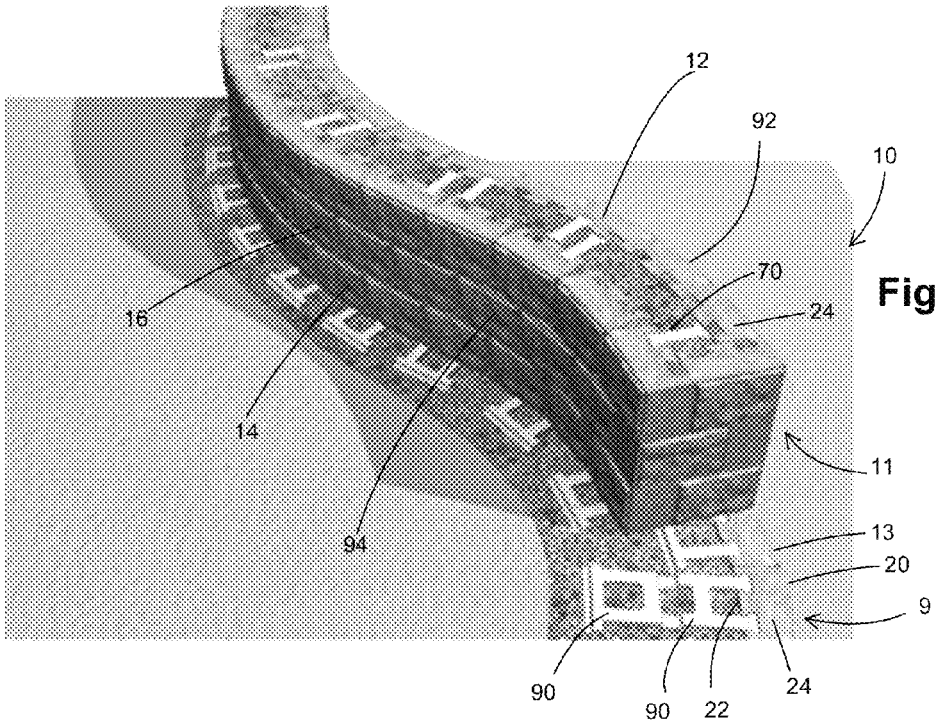
FIG. 2 is a back perspective view of the retaining wall and parapet of FIG. 1 with the cap removed.

The following detailed description is exemplary in nature and is not intended to limit the scope, applicability, or configuration of the invention in any way. Rather, the following description provides practical illustrations for implementing exemplary embodiments of the invention. FIGS. 1 and 2 are back perspective views of a mortarless wall 10 including a retaining wall 9 and parapet 11 constructed of a plurality of multi-component segmental wall blocks 12 according to some embodiments of the present invention, shown with and without a cap 8. The retaining wall 9 portion of wall 10 consists of multiple courses of segmental wall blocks 12, the bottom course stacked upon the ground, and each course thereafter stacked upon an underlying course of blocks. In FIGS. 1 and 2, only the top course 13 can be seen. Any number of courses are within the scope of the present invention. The blocks 12 include a face unit 24 as well as an anchoring unit 90. The front faces 20 of blocks 12 of the wall 9 are typically exposed as shown. The rear faces 22 of blocks 12 of the wall 9, however, are typically hidden from view and are confronting soil being retained in place by the wall 9. The soil, of course, creates pressure on the rear face 22 and its blocks 12, tending to push the blocks 12 forward. However, the presence of anchoring units 90 within the soil tends to stabilize the retaining wall 9, as described further below.

Like the retaining wall 9, the parapet 11 portion of the wall 10 shown in FIGS. 1 and 2 is constructed of a plurality of segmental wall blocks 12 according to some embodiments of the present invention. The parapet 11 consists of a first course 14 of segmental wall blocks 12 and a second course 16 of blocks 12 stacked over the first course 14. Any number of courses are within the scope of the present invention. The segmental wall block 12 includes a face unit 24 and may also include one or more anchoring units 70. In alternative embodiments, the segmental wall block includes two face units 24 and one or more anchoring units 70 joining the face units, as described further below. Although the embodiments shown include a parapet 11 atop a retaining wall, other embodiments can include a retaining wall alone, a parapet as a free standing wall on the ground without an underlying retaining wall, or a parapet alone atop a different structure or surface.

Figure 3A:
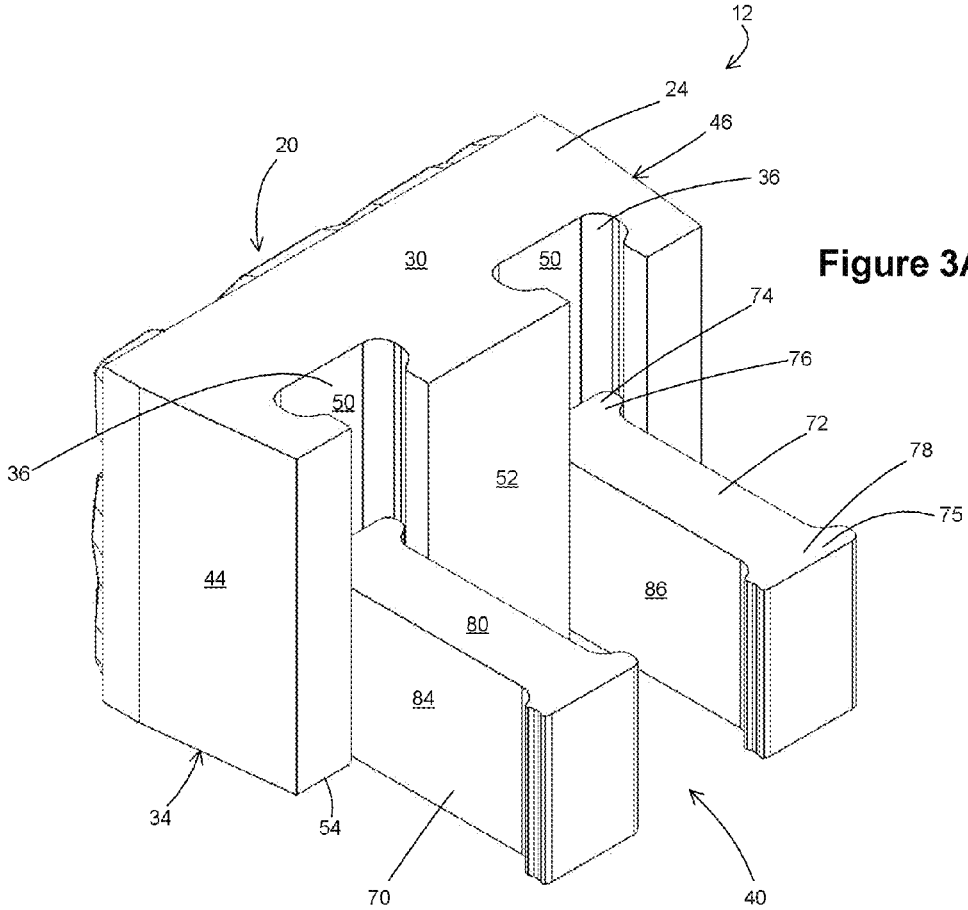
FIG. 3A is a back perspective view of segmental wall block according to embodiments of the invention.
Figure 3B:
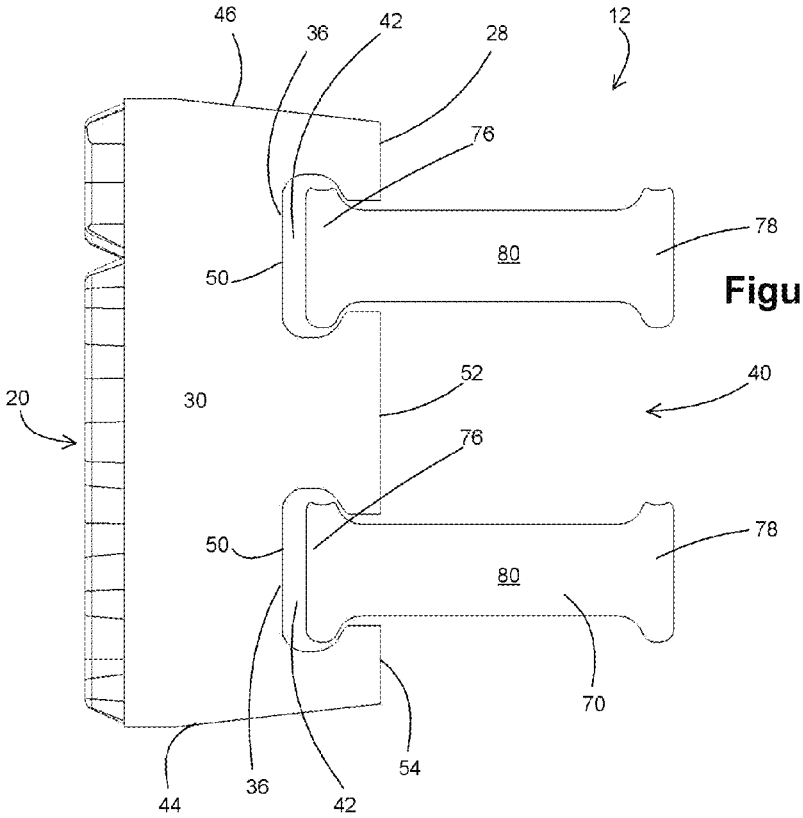
FIG. 3B is a top view of the segmental wall block of FIG. 3A.
Figure 3C:
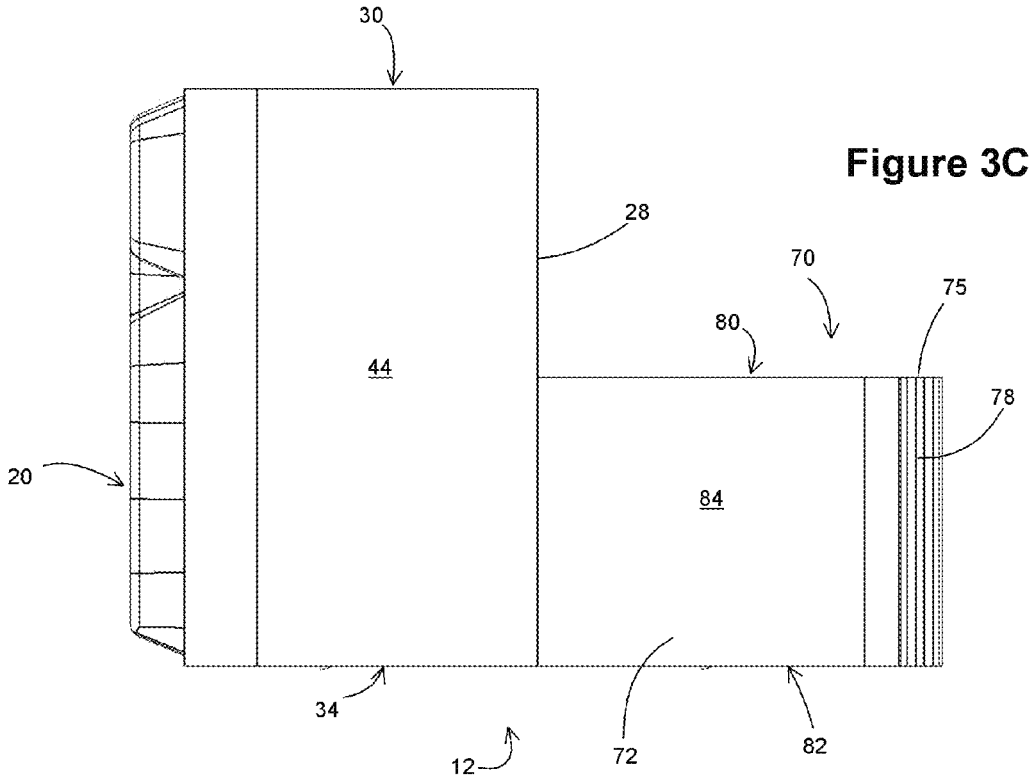
FIG. 3C is a side view of the segmental wall block of FIG. 3A.

FIG. 3A is a back perspective view of a segmental wall block 12 according to some embodiments of the invention. FIG. 3B is a top view of the segmental wall block 12 of FIG. 3A, and FIG. 3C is a side view of the segmental wall block 12 of FIG. 3B. As shown, the block 12 is comprised of two or more components, including a face unit 24 and a first anchoring unit 70. In the embodiment shown, the block 12 further includes an optional second anchoring unit 70. In other embodiments, the block may further include an optional third anchoring unit 70 (not shown), and in still other embodiments, the block 12 may further include an optional fourth anchoring unit 70 (not shown), stacked upon the first and second anchoring units 70. The first anchoring unit 70 and second anchoring unit 70 are interlocked with the face unit 24 via respective connector elements. The face unit 24 has a front face 20 that defines part of the exposed surface of the retaining wall. The face unit 24 also has two channels 36 described further below. The anchoring unit 70 has a first end 74 forming a first connector 76 and a second end 74 forming a second connector 78. The first connector 76 is interconnected with the face unit 24, while the second connector 78 may be located within soil when used to form a retaining wall 10 or may interconnect with another face unit 24 to form a parapet 11.

Several advantages are realized by forming block 12 of two or more interlockable components. For instance, for those persons who move, stack, or otherwise handle blocks from production to ultimate placement and wall assembly, it is much easier to lift, move, and accurately place a block component than it is to lift, move, and accurately place an entire one-piece block. Other advantages of the multi-component design are provided below.

The wall 10 in FIGS. 1 and 2 do not require mortar and can be mortarless. The blocks 12 have parallel load bearing surfaces on the top and bottom of the block 12. The upper load bearing surface is formed by the face unit upper surface 30. The lower load bearing surface is formed by the face unit lower surface 34. The anchoring units 70 also have a planar upper surface 82 and lower surface 84 which can be load bearing depending upon how they are deployed. For example, in cases where two anchoring units 70 are used directly on top directly of each other, within the same channel 36, the upper surface 82 of the upper anchoring unit 70 can provide an additional upper load bearing surface and the lower surface 84 of the lower anchoring unit 26 can provide an additional lower load bearing surface. In addition, when the second ends 75 of anchoring units 70 of blocks 12 of opposing sides of a parapet overlap each other, the upper surface 82 of the upper anchoring unit and the lower surface 84 of the lower anchoring unit 26 can act as load bearing surfaces. In addition, other types of anchoring units, such as the U-shaped anchoring unit 27 shown in FIGS. 1 and 2 and as described further below have upper and lower surfaces that can provide upper and lower load bearing surfaces and can be used instead of or in combination with, anchoring units 70. The load bearing surfaces are formed transversely to the front face 20 and the rear face 22. Face unit 24 also has side walls 44, 46 formed transversely to the upper surface 30. In the embodiment shown, the side walls 44, 46 extend the entire height of the block, from the lower load bearing surface to the upper load bearing surface. In other embodiments, the side walls 44, 46 do not extend the entire distance between the upper and load bearing surfaces.

When the face unit 24 and the first and second anchoring unit 70 are interlocked, as shown in FIGS. 3A and 3B, the anchoring units 26 are spaced apart to form a slot 40. Slot 40 extends vertically through the block from the lower bearing surface to the upper load bearing surface and is bounded by inner side walls of the anchoring unit 70 and the face unit 24. Slot 40 provides several advantages. First, slot 40 reduces the quantity of material required for production of the block 12, which is a cost reduction feature. Slot 40 also reduces the weight per square foot of the block 12 without sacrificing the load bearing strength. This feature lightens the load for shipping as well as for those persons who move, stack, or otherwise handle the individual blocks from production to ultimate placement and wall assembly. The slot 40 of each block 12 in the wall may also be filled with a rock or earthen fill to stabilize and reinforce the wall 10, such as against the soil pressure. Such fill may include a clean granular backfill, such as clean crushed rock or binder rock, or on-site soils such as, for example, black earth, typically containing quantities of clay and salt. This fill may also be used generally between blocks 12, filling any gaps between adjacent blocks. As noted below, the relative positions of the channels 36 and the anchoring unit connectors 76, 78 form an interlock that is stabilized via the addition of fill in the slot 40 and other spaces between the blocks 12. That is, the connectors 76, 78 permit relative vertical movement between the face unit 24 and the anchoring unit 70 but resist and generally reduce or prevent relative longitudinal (front to back) movement and lateral (side to side) movement between the face unit 24 and the anchoring unit 70. The fill adds pressure internal to and around block 12 to further restrict all relative movement between the face unit 24 and the anchoring unit 70 once they are positioned as desired.

FIG. 36 shows a small gap 42 in the interface between each connector 76 and each channel 36 providing a loose connection between the face unit 24 and anchoring unit 70. The small gap 42 provides for easier assembly of the anchoring unit 70 and face unit 24 into a block 12 and allows for limited relative movement (play) between the anchoring unit 70 and the face unit 24 without disconnecting the interlock. For example, the anchoring unit 26 may be able to rotate horizontally somewhat within the channel, such as by an amount that is between about 5 and about 25 degrees in each direction, or between about 10 and about 14 degrees in each direction, relative to perpendicular to the front face 20. In some embodiments, the anchoring unit 26 is able to rotate horizontally about 12 degrees within the channel in each direction, for a total range of horizontal rotation of about 24 degrees. In addition, the anchoring units 26 may be able to tilt vertically somewhat within the channel, such as by an amount that is between about 1 and about 8 degrees in each direction, or between about 2 and about 5 degrees in each direction, relative to perpendicular to the front face 20. In some embodiments, the anchoring unit 26 is able to tilt vertically about 3.5 degrees within the channel in each vertical direction, for a total range of vertical tilt of about 7 degrees. With the "play" as described above, the block 12 conforms better to lower courses or the terrain. Further, it makes it easier to interconnect a single anchoring unit 26 to two face units 70, even if the channels of each face unit 24 are not precisely aligned with each other. In addition, the play can allow the anchoring units 26 of opposing sides of a parapet to be rotated slightly to enable overlap or to increase overlap of the anchoring units 70 such that, together, they provide upper and lower load bearing surfaces as described above.

With reference to FIGS. 3A, 3B and 3C, the face unit 24 has opposing parallel front 20 and rear 28 faces, opposing parallel upper 30 and lower 34 surfaces, and opposing right 44 and left 46 side surfaces. The upper 30 and lower 34 surfaces are generally transverse to the front 20 and rear faces 28 and are substantially planar. The upper 30 and lower 34 surfaces function as load bearing surfaces, where the upper surface 30 supports the lower surface 34 of a super-imposed stacked block. Since the upper 30 and lower 34 surfaces are substantially flat, the face units 24 may be stacked with or without a setback. The front face 20 may have a pattern molded or formed thereon, as shown in FIGS. 1 and 2. The rear face 28 is generally planar and has two channels 36 for interconnection with the connectors 72 of anchoring units 26. In the embodiment shown, the channels 36 are formed as recesses or pockets in the rear face 28. The channels 36 are shaped as elongated keyways that run the entire height of the face unit 24, from the lower surface 34 to the upper surface 30. The channels 36 are shaped to permit relative vertical movement between the face unit 24 and the anchoring units 70, but to generally restrict movement in other directions. The channels 36 could be of other shapes long as they remain of complementary size and shape to the anchoring unit connectors 76, 78. The generally flat surface 50 forming the innermost surface of the channel 36 leaves more mass intact in the face unit 24 and adds strength to the face unit 24. That is, the channel 36 extends inward less than half the depth of the face unit 24 due, in part, to the flat surface 50 formed by the channel 36. Between the channels 36 is a central portion 52 of the rear face 28. Outside of the channels 36 are outer portions 54 of the rear face 28. The central portion 52 forms one of the walls of the slot 40. In some embodiments, the face unit 24 is about one foot wide, almost 6 inches deep, about 8 inches high and the central portion 52 of the rear face 28 is about 4 inches wide, which corresponds to the width of the slot 40.

In the embodiment shown in FIGS. 3A, 3B and 3C, the side walls 44, 46 of face unit 24 taper inwardly rearwardly. The taper permits the face units 24 to be placed such that the front faces 20 are angled relative to each other. For instance, if it is desired that the retaining wall be constructed to form a convex curve (from the perspective of the front), the tapered sides 44, 46 provide adequate relief to all the face units 24 to be angled relative to each other. In other embodiments, one or both sides 44, 46 of the face unit 24 are instead transverse to the front face 20. Accordingly, such face units may be used as part of the block that forms the end block or last block in a course of blocks of a wall. In certain embodiments of face units 24, the face unit 24 includes an alignment element formed as pin recesses or apertures. In some embodiments, such apertures extend vertically through the entire height of face unit. The face unit 24 may be positioned such that one or more apertures of one face unit 24 may be aligned the corresponding one or more apertures of subjacent and superimposed face units 24.

Figure 4A:
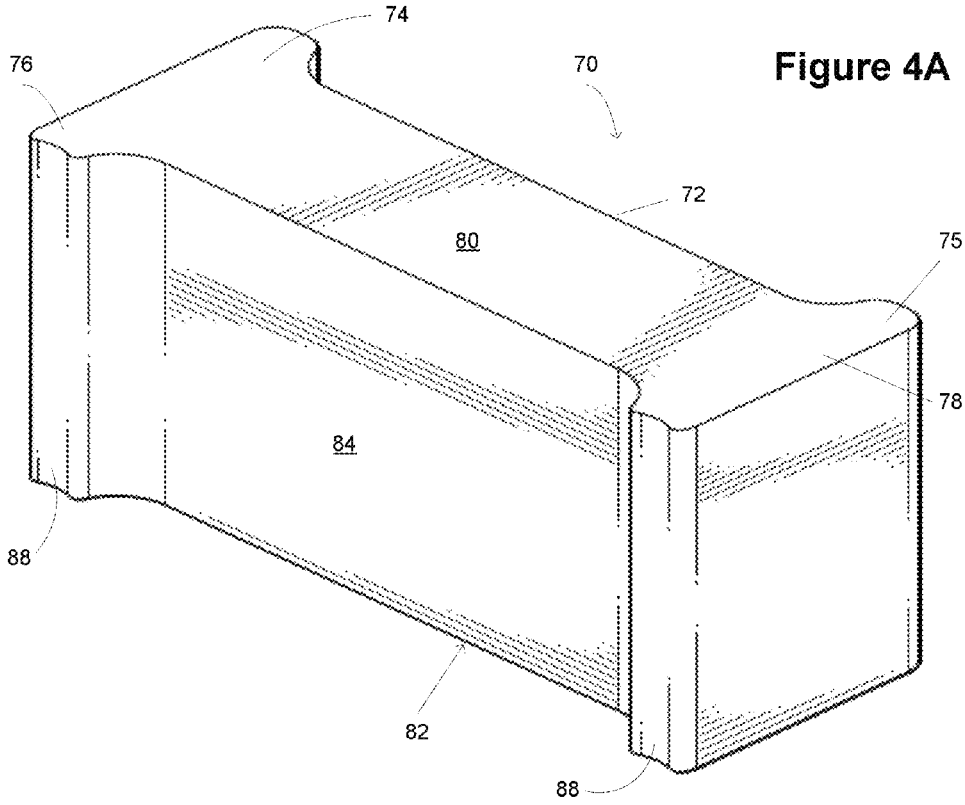
FIG. 4A is a perspective view of an anchoring unit according to embodiments of the invention.
Figure 4B:
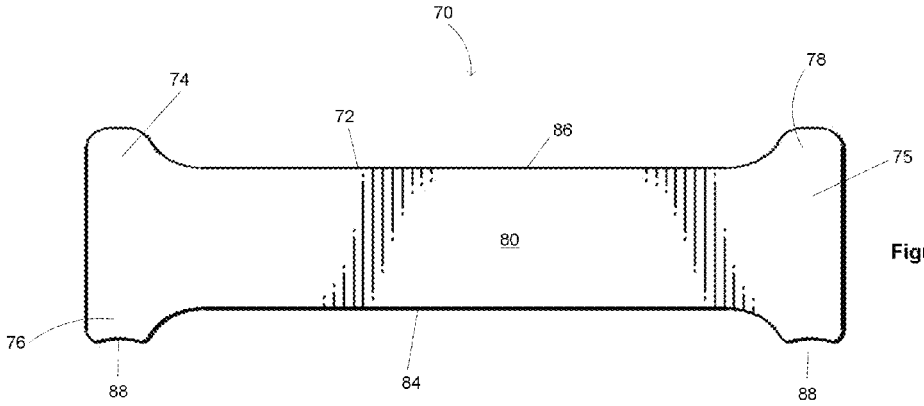
FIG. 4B is a top view of the anchoring unit of FIG. 4A.
Figure 4C:
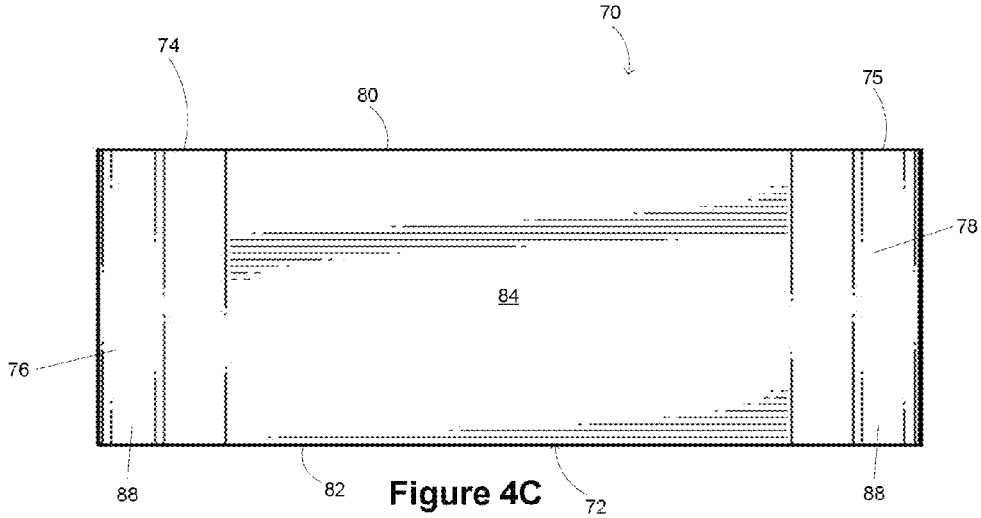
FIG. 4C is a side view of the anchoring unit of FIG. 4A.

FIG. 4A is a perspective view of an anchoring unit 70 of a block 12 according to some embodiments of the invention. FIG. 4B is a top view of the anchoring unit 70 of FIG. 4A and FIG. 4C is a side view of the anchoring unit 70 of FIG. 4A. The anchoring unit 70 includes an elongated central portion 72, a first end 74 and a second end 75. The first end 74 is flared laterally outward of the central portion 72 to form a first connector 76. The second end 75 is flared laterally outward of the central portion 72 to form the second connector 78. The connectors 76, 78 are sized to slide into and be interlocked with the channels 36 of the face unit 24. The anchoring unit 70 further includes an upper surface 80 and a lower surface 82 opposed to the upper surface 80, both of which are substantially planar. The distance between the upper and lower surfaces 80, 82 forms the height of the anchoring unit 70, which is uniform across the length of the unit 70 from the first end 74 to the second end 76. The first side surface 84 and a second side surface 86 orthogonal to the upper and lower surfaces 80, 82. In some embodiments, the height of the anchoring unit 70 is approximately equal to one half of the length of the channels 36 and to one half of the height of the face unit 24, such that two anchoring units 70 can fit into each channel 36 and the upper surface 80 of the upper anchoring unit 70 will be in the same horizontal plane as the upper surface 30 of the face unit, while the lower surface 82 of the lower anchoring unit 70 will be in the same horizontal plane as the lower surface 34 of the face unit 24 with which the anchoring unites 70 are connected.

In the embodiment shown, the connectors 76, 78 are shaped as hammer-head keys that extend the entire height of the anchoring unit 26. The connectors 76, 78 are of complementary shapes to the face unit channels 36 for interconnection therewith. In the embodiment shown, both the first 76 and the second connectors 78 are of the same shape and/or size such that they are mirror images of each other. It is understood, though, that first 76 and second 78 connectors may be of different shapes and/or sizes as long as the channels 36 of the face unit 24 are constructed of complementary shapes and/or sizes for interconnection therewith. For instance, the connector shape could be a circular instead of a flat hammerhead.

It is further noted that the connectors 76, 78 may include grooves 88 extending from the upper surface 80 of the anchoring unit 70 to the lower surface 82 of the anchoring unit 70 as shown, in FIGS. 4A, 4B and 4C. In some embodiments, each anchoring unit includes two grooves 88. In the embodiment shown, a first groove 88 is located on the first side surface 84 of the first connector 76 and a second groove 88 is located on the first side surface 84 (the same side surface) of the second connector 78. Alternatively, the second groove 80 can be located on the second side surface 86 of the first connector 76 (such that both grooves 88 are on opposite sides of the same connector) or on the second side surface 86 of the second connector 78 (such that the grooves 88 are kiddy corner from each other, being on opposite sides and opposite ends of the anchoring unit 70).

Figure 5:
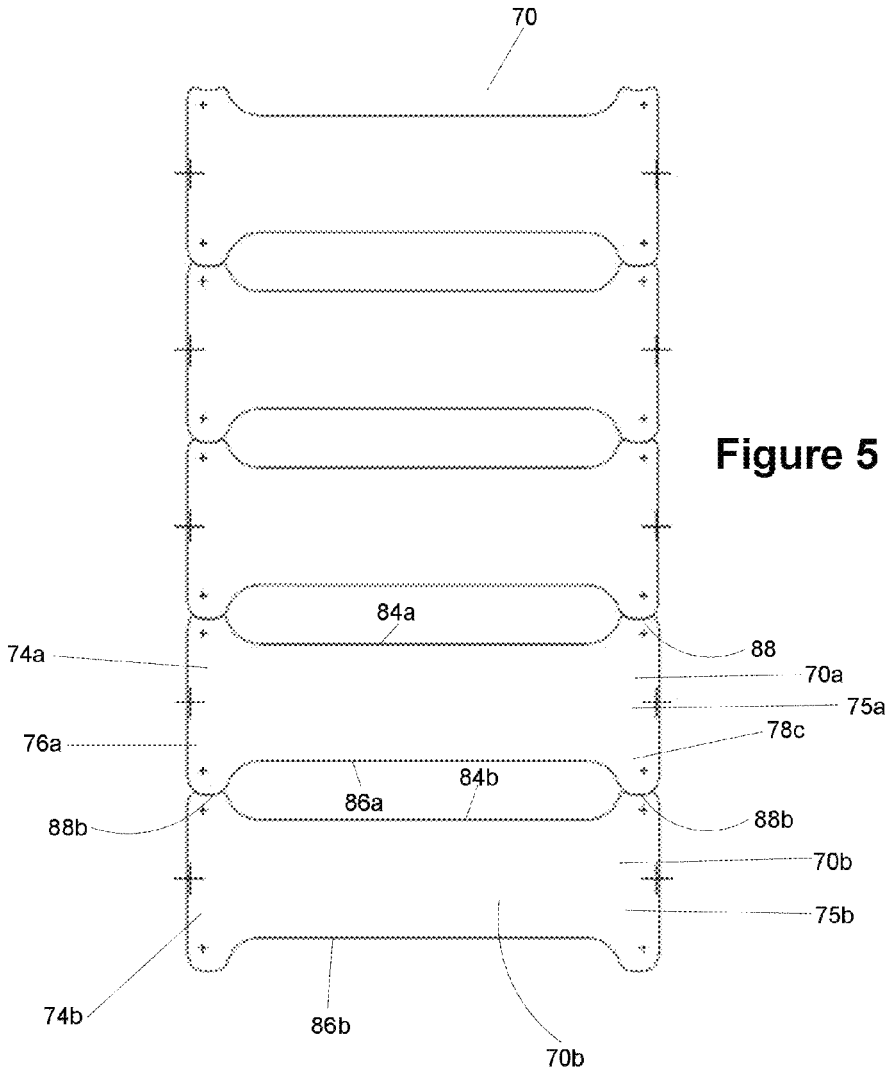
FIG. 5 is a top view of anchoring units in a nesting relationship.

Face units 24 and anchoring units 70 are likely manufactured some distance away from the site where they will be assembled into a retaining wall and/or parapet. Accordingly, they must be transported to the installation location. FIG. 5 shows a top view of a plurality of anchoring units 70 abutting one another, as they would be on a pallet. As can be seen in FIG. 5, the grooves 88 are shaped and positioned to allow the anchoring units 70 to nest together when stacked. When a first anchoring unit 70*a* and a second anchoring unit 70*b* are placed in abutment, one or both connectors 76*a*, 78*a* of the first anchoring unit 70*a* can nest within one or both grooves 88*b* of the second anchoring unit 70*b*. In the embodiment shown, the anchoring unit 70*a* having both grooves 88*a* on the same side 84*a* but on opposite ends 74*a*, 75*a*, both connectors 76*a*, 78*a* of the first anchoring unit 70*a* nest within both grooves 88*b* of the second anchoring unit 70*b*. In alternative embodiments, either having both grooves 80 on the same connector 76, 78 or having the grooves 88 kiddy corner on opposite sides and opposite connectors 76, 78, each side of the anchoring unit has only one grove 88. In such embodiments, the first and second anchoring units 70 can be aligned such that one of the connectors 72, 74 of the first anchoring unit 70 can nest within a groove 88 of the second anchoring unit 70, and one of the connectors 72, 74 of the second anchoring unit 70 can nest within the groove 88 of the first anchoring unit 70. In this way, the anchoring units 70 can be abutted in a nesting manner such that they are aligned and have increased stability for storage or shipment. This advantage is important because, although the upper and lower surfaces 80, 82 are flat and can be stacked, the curved nature of the connectors 72, 78 makes stable and secure positioning of the anchoring units 70 within a layer such as on a pallet, difficult. The placement of the nesting groove creates stability between adjacent abutting connectors 70.

It should further be noted that the face units 24 may be used with other types of anchoring units. The use of other anchoring units may be particularly useful when the face units 24 are used to create a retaining wall, where there is no need for a second connector to connect to another face unit or for connectors to overlap to form a parapet. In such cases, it may therefore be preferable to use an anchoring unit which provides greater stability in the earth and/or provides a better base of support for overlying blocks 10. An example of an alternative anchoring unit is the U-shaped anchoring unit 90 shown in FIGS. 1 and 2 and described in U.S. patent application Ser. No. 12/882,257, the disclosure of which is hereby incorporated by reference.

In some embodiments, such as those shown in FIGS. 1 and 2, the wall 10 includes both a retaining wall 9 and a parapet 11, and the parapet 11 is constructed above, and is supported by, the retaining wall 9. In some such embodiments, the retaining wall 9 can be constructed of blocks 12 including face units 24 as described herein and U-shaped anchoring units 90, while the parapet 11 can be constructed of blocks 12 including face units 24 and anchoring units 70 as shown. In other such embodiments, both the retaining wall 9 and the parapet 11 can be constructed of blocks 12 including face units 24 and anchoring units 70. In still other embodiments, the retaining wall 9 is constructed of face units 24, some of which are connected to U-shaped anchoring units and others of which are connected to anchoring units 70, while the parapet 11 is constructed of face units 24 and anchoring units 70 and may or may not also include U-shaped anchoring units 90. The face units 24 of the retaining wall 9 may be identical to the face units 24 of the parapet 11, such that the wall 10 appears uniform, with no visible difference between the front faces 20 of the retaining wall face units 24 and the front faces 20 of the parapet face units 24 above them.

Figure 6:
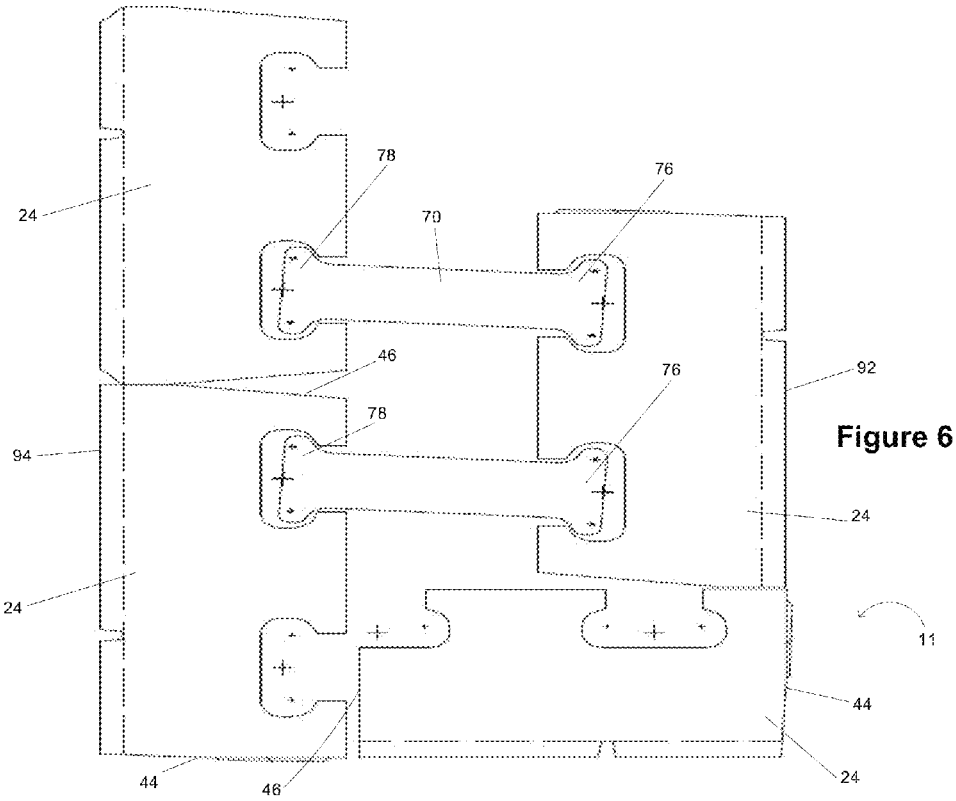
FIG. 6 is a top view of a portion of a parapet according to embodiments of the invention.
Figure 7:
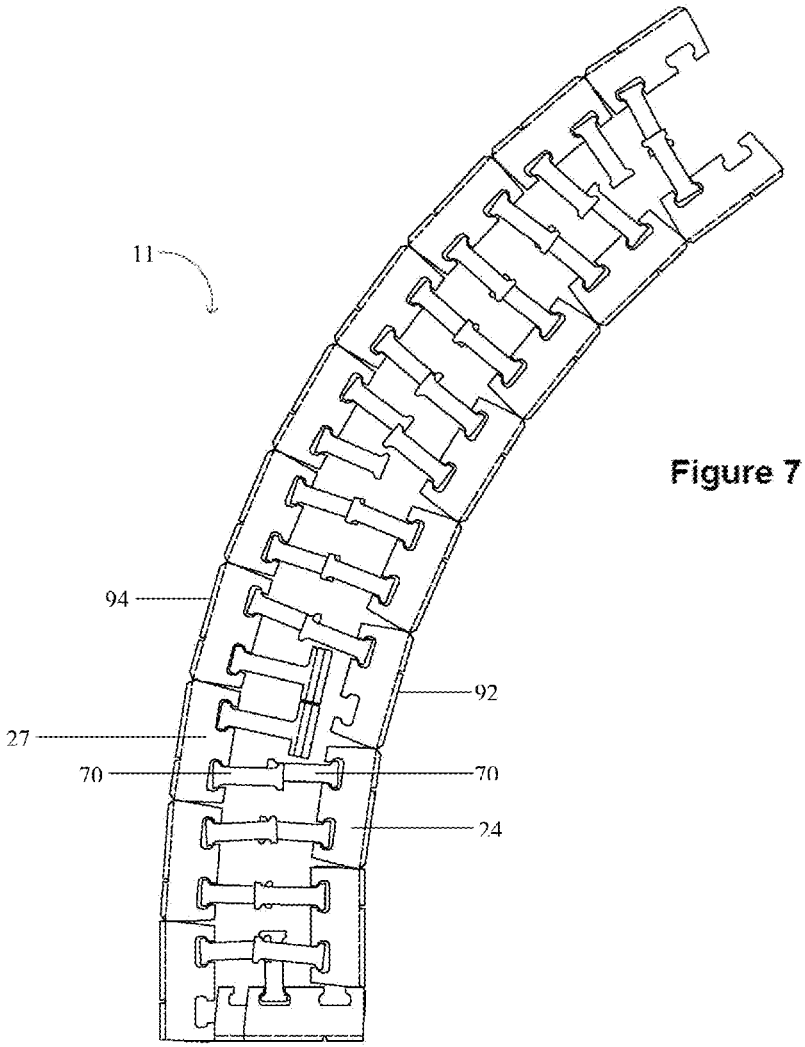
FIG. 7 is a top view of a portion of an alternative parapet according to embodiments of the invention.

The anchoring units 70 as described herein provide several unique advantages. First, the flared second end 74 functions not only as a connector 78 but also to resist movement when surrounded by earth or fill material and thereby provide stability. In addition, by having connectors at each end, the anchoring units 70 are able to interconnect with two face units 24, creating a more stable parapet, as shown in FIG. 6, for example. As shown, the anchoring units 70 span the parapet 11 with the first connectors 76 connected to the face units 24 of the first side 92 and the second connectors 78 connected to the face units 24 of the second side 94. However, even when the face units 24 of each side of the parapet 11 are spaced apart too far for the separation to be spanned by an anchoring unit 70, the design of the anchoring units 70 provides additional advantages. FIG. 7 is a top view of such a parapet 11. The parapet 11 includes a first side 92 and a second side 94. It can be seen that the face units 24 of the first side 92 and the second side 94 are spaced apart too far to be interconnected by anchoring units 70, given the length of the anchoring units 70 in this example. However, it can also be seen that the anchoring units 70 of the first side 92 are overlapping the anchoring units 70 of the second side 94. This is possible because of the heights of the anchoring units 70 relative to the face units 24. The anchoring units 70 in this example have a height that is approximately half the height of the face units 24. As such, in some embodiments, each channel 36 can accommodate two anchoring units 70 stacked atop each other within the channel 36, such that the total height of the two anchoring units 70 is approximately equal to the height of the face unit 24. Alternatively, as shown in FIG. 7, anchoring units 70 of the first side 92 can overlap with anchoring units 70 of a second side in the same row or vice versa. Together the overlapping anchoring units 70 have a height approximately equal to the height of face units 24. In this way, the blocks 12 allow for flexibility in the spacing of the first and second sides 92, 94 of the parapet 11. For example, the sides 92, 94 can be spaced a distance determined by the length of the anchoring units 70 such that each face is interconnected to a common anchoring unit 70, or by a distance that is greater than the distance spanned by the anchoring units but at which the anchoring units of each face overlap, or by a distance at which the anchoring units of each face are so far apart that they do not overlap. FIG. 7 also illustrates the option of including alternative anchoring units such as anchoring unit 96 which is a U-shaped anchor 90 as shown in FIG. 1 which has been split in half to include only a single connector.

Face units 24 and anchoring units 70 may be manufactured using many different methods, including wetcast, drycast, or an extrusion. For instance, the face unit or the anchoring unit can be made through a process similar to that taught in Gravier, U.S. Pat. No. 5,484,236, the disclosure of which is incorporated herein by reference. An upwardly open mold box having walls defining one or more of the exterior surfaces of the block components is positioned on a conveyor belt. A removable top mold portion is configured to match other surfaces of the block component. A zero slump concrete slurry is poured into the mold and the top mold portion is inserted, with care being taken to distribute the slurry throughout the interior of the mold, following which the top mold portion is removed, as are the front, rear and side walls of the mold box, and the block components are allowed to fully cure. Any reference to "top" or "upper" may in fact be the bottom, lower, or any other surface as the blocks are ultimately oriented. The same applies to references to bottom, front, lower, and side surfaces. In some embodiments in accordance with the invention, core bars of various sizes may be used to create anchoring units and face units. For instance, core bars may be used to create the alignment elements discussed herein, including lips, notches, pin recesses, and slots. Core pulling techniques such as disclosed in U.S. Pat. No. 5,484,236, entitled "METHOD OF FORMING CONCRETE RETAINING WALL BLOCK", assigned to the same assignee as the present invention, may be employed in production.

Since the block components are smaller than fully assembled blocks 12, multiple components may be formed at a time in a single mold box. In embodiments of the present invention, it is possible that multiple composite blocks may be formed, where the composite blocks are split into face units with textured stacking surfaces. Surfaces of the mold box or the surface of a divider plate inserted into the mold box may be embossed with different patterns so that the stacking surfaces of the face units may be embossed with a pattern.

Independent of the manufacturing process used, the face units 24 may be formed of different materials than those used for the anchoring units. Both may be formed of concrete, but the anchoring units 70 may use a higher percentage of recycled materials. Alternatively, the face unit may be formed of concrete while the anchoring unit is formed of plastic.

In the foregoing detailed description, the invention has been described with reference to specific embodiments. However, it may be appreciated that various modifications and changes can be made without departing from the scope of the invention as set forth in the appended claims.

The invention claimed is:

1. A mortarless retaining wall constructed of a plurality of segmental wall blocks stacked in an array of superimposed rows, each segmental wall block comprising:

a face unit comprising a front face, a rear face opposite the front face, an upper surface, a lower surface opposite the upper surface, and one or more channels formed in the rear face, the channels extending from the upper surface to the lower surface along a face unit height, the front face being exposed and the rear face being hidden, the rear face confronting soil or granular fill being retained by the retaining wall, the upper face for supporting the lower face of a super-imposed stacked segmental wall block, the upper and lower faces resisting shear forces between adjacent segmental wall blocks, the shear forces applied by the soil or granular fill retained by the retaining wall against the segmental wall block;

one or more anchoring units each comprising a first end forming a first connector, a second end forming a second connector, a central portion extending from the first end to the second end, an upper surface, and a lower surface opposite the upper surface, wherein a distance between the upper surface and the lower surface forms a height of the anchoring unit which is substantially uniform from the first end to the second end of the anchoring unit such that the upper surface abuts the lower surface of a super-imposed stacked anchoring unit, and wherein at least one of the first and second connectors is sized to slide into and be interlocked with the channels of at least one of the face units; and wherein the height of the anchoring unit is substantially one half of the face unit height such that two stacked anchoring units are of substantially equal height as the face unit.

2. The retaining wall of claim 1, wherein the first connector has a shape which is a mirror image of a shape of the second connector.

3. The retaining wall of claim 1, the first end flaring laterally outward of the central portion to form the first connector, the second end flaring laterally outward of the central portion to form the second connector.

4. The retaining wall of claim 3, each anchoring unit further comprising:

first and second opposing side surfaces;

a first groove on the first side surface of the first connector;

a second groove on either the first side surface of the second connector or on the second side surface of the first or the second connector;

wherein each of the first and second grooves extend from the upper surface to the lower surface of the anchoring unit; and wherein the connectors and the grooves are positioned and shaped such that when a first and a second anchoring unit are placed in abutment, one or both connectors of the first anchoring unit can nest within one or both grooves of the second anchoring unit.

5. The retaining wall of claim 1, wherein each of the first and second connectors is sized to form a gap between an inner wall of the channel and the connector when the connector is placed within the channel.

6. The retaining wall of claim 5 wherein, when the connector is placed within the channel, the gap allows the anchoring unit to rotate laterally within the channel up to about 24 degrees.

7. The retaining wall of claim 1, wherein the one or more channels comprises two channels and the one or more anchoring units comprises two anchoring units.

8. The retaining wall of claim 1, wherein the first and second connectors of one of the anchoring units are sized to simultaneously slide into and be interlocked with the channels of two of the face units to construct a parapet wall.

9. The retaining wall of claim 1, wherein the first connectors of two of the anchoring units are sized to simultaneously slide into and be interlocked with the channels of two of the face units, whereby the two of the anchoring units may be stacked when interlocked to reach a combined height equal to the face unit height.

10. A mortarless parapet wall constructed of a plurality of segmental wall blocks positioned to form multiple, stacked courses:

each segmental wall block comprising:

two or more face units each comprising a front face, a rear face opposite the front face, an upper surface, a lower surface opposite the upper surface, and one or more channels formed in the rear face, the channels extending from the upper surface to the lower surface along a face unit height, the rear faces of the two or more face units oriented to face each other;

one or more anchoring units each comprising a central portion extending from a first end to a second end, each anchoring unit having a first side surface and a second side surface opposite the first side surface, the first end flaring outward of the central portion in a lateral direction from the first side surface to the second side surface to form a first connector, the second end flaring outward of the central portion in a lateral direction from the first side surface to the second side surface to form a second connector, the first and second connectors being sized to slide into and be interlocked with the channels of the two or more face units, one or more of the anchoring units positioned such that at least one of the first and second connectors is interlocked with the channels of at least one of the two of the face units; and a granular fill or soil filling gaps between the rear faces of the two or more face units oriented to face each other, the granular fill stabilizing and reinforcing the parapet wall wherein, for at least one of the plurality of segmental wall blocks of the parapet wall, the one or more of the anchoring units are positioned such that the first and second connectors are interlocked with the channels of both of the two of the face units; and wherein, for at least another one of the plurality of segmental wall blocks of the parapet wall, the one or more of the anchoring units positioned such that the first connector is interlocked with the channel of one of the two of the face units, and the second connector confronts the soil or the granular fill between the two of the face units, the flaring of the second connector providing an anchor in the soil or granular fill to resist movement and provide stability.

11. The parapet wall of claim 10, wherein the first connector has a shape which is a mirror image of a shape of the second connector.

12. The parapet wall of claim 10, wherein each anchoring unit has an upper surface and a lower surface opposite the upper surface, wherein a distance between the upper surface and the lower surface forms a height of the anchoring unit which is substantially uniform from the first end to the second end of the anchoring unit.

13. The parapet wall of claim 10, further comprising:

a first groove in the first side surface of the first connector, the groove extending from the upper surface to the lower surface of anchoring unit; and a second groove in either the first side surface of the second connector or in the second side surface of the first or the second connector, the second groove extending from the upper surface to the lower surface of the anchoring unit;

the first and second connectors and the first and second grooves are positioned and shaped such that when a first and a second anchoring unit are placed in abutment, one or both connectors of the first anchoring unit can nest within one or both grooves of the second anchoring unit, whereby the nesting provides an alignment mechanism for the one or more anchoring units when palletized for shipment.

14. A mortarless wall forming a combination retaining wall and parapet wall, comprising:

a mortarless retaining wall portion of the wall constructed of a first plurality of segmental retaining wall blocks positioned to form at least one course of the retaining wall portion, each segmental retaining wall block of the retaining wall portion comprising:

a face unit each including a front face, a rear face opposite the front face, an upper surface, a lower surface opposite the upper surface, and one or more channels formed in the rear face, the channels extending from the upper surface to the lower surface along a face unit height, the front face being exposed and the rear face being hidden, the rear face confronting soil or granular fill being retained by the retaining wall, the upper face for supporting the lower face of a super-imposed stacked segmental retaining wall block, the upper and lower faces resisting shear forces between adjacent segmental retaining wall blocks, the shear forces applied by the soil or granular fill retained by the retaining wall against the segmental retaining wall block, and one or more anchoring units each comprising a central portion extending from a first end to a second end, each anchoring unit having a first side surface and a second side surface opposite the first side surface, the first end flaring outward of the central portion in a lateral direction from the first side surface to the second side surface to form a first connector, the second end flaring outward of the central portion in a lateral direction from the first side surface to the second side surface to form a second connector, and the first connector interlocked with one of the channels of the face unit, the second connector confronting the soil or granular fill being retained by the retaining wall, the flaring of the second connector providing an anchor in the soil or granular fill to resist movement and provide stability;

a mortarless parapet wall portion of the wall positioned on the retaining wall portion and constructed of a second plurality of segmental parapet wall blocks, the second plurality of segmental parapet wall blocks positioned to form at least one course of the parapet wall portion, each segmental parapet wall block of the parapet wall portion comprising:

two or more of the face units, the rear faces of the two or more face units oriented to face each other, one or more of the anchoring units positioned such that at least one of the first and second connectors is interlocked with the channels of at least one of the two of the face units; and a granular fill or soil filling gaps between the rear faces of the two or more face units oriented to face each other, the granular fill or soil stabilizing and reinforcing the parapet wall portion.

15. The wall of claim 14, wherein the height of each anchoring unit is substantially one half of the face unit height.

16. The wall of claim 14, wherein the two or more face units of each segmental parapet wall block of the parapet wall portion are positioned in a staggered configuration.

17. The wall of claim 14, wherein the wall is curved.

18. The wall of claim 14, wherein the anchoring units interlocked with the channels of the face units are interlocked with a gap that allows the anchoring unit to rotate laterally within the channel by an amount of up to about 24 degrees.

19. The wall of claim 14, wherein the first connector has a shape which is a mirror image of a shape of the second connector.

20. The wall of claim 14, wherein the one or more of the anchoring units are positioned such that the first and second connectors are interlocked with the channels of both of the two of the face units.

* * * * *